United States Patent [19]

Suga

[11] Patent Number: 4,732,366

[45] Date of Patent: Mar. 22, 1988

[54] ARM UNIT FOR USE IN PANTOGRAPH TYPE JACK

[75] Inventor: Hiroko Suga, Kawagoe, Japan

[73] Assignee: Riken Kaki Kogyo Co., Ltd., Saitama, Japan

[21] Appl. No.: 934,962

[22] Filed: Nov. 25, 1986

[51] Int. Cl.[4] ..... B66F 3/12

[52] U.S. Cl. ..... 254/126

[58] Field of Search ..... 254/122, 126

[56] References Cited

U.S. PATENT DOCUMENTS 4,025,054 5/1977 Yamuzaki ..... 254/126

FOREIGN PATENT DOCUMENTS 2323627 12/1975 France ..... 254/126

57-166343 9/1982 Japan .

*Primary Examiner*—Robert C. Watson

*Attorney, Agent, or Firm*—Armstrong, Nikaido, Marmelstein & Kubovcik

[57] ABSTRACT

An arm unit for use in a pantograph type jack wherein a main driving cam having an effective cam face constituted with an arc of a circle is formed to one side plate at the mounting end of a U-cross sectioned arm on the side of a bearing member with the effective cam face being protruded forwardly and upwardly from the mounting hole for the shaft bearing member, whereas a driven cam with a relatively moderate and long cam face different from the shape of the main driving cam is formed to the other of the side plates such that, when a pair of opposed arms is an identical shape pivoted to the bearing member are rotated in the directions opposing to each at an equal angular velocity, the main driving cam and the driven cam for each of the arms are faced and brought into engagement under contact with each other.

3 Claims, 6 Drawing Figures

ARM UNIT FOR USE IN PANTOGRAPH TYPE JACK

BACKGROUND OF THE INVENTION

1. Field of the Invention

This invention concerns an arm unit of a jack and, particularly, it relates to an improvement of an arm unit for use in a pantograph type jack having four arms combined in a rhombic link structure for jacking the weight of automobiles.

2. Description of the Prior Art

As has been well-known, a pantograph type jack usually comprises a pair of lower right and left arms pivoted to a lower bearing member of a grounded base and a pair of upper right and left arms pivoted to an upper bearing member of a load receiver, in which the ends of the respective arms opposed to each other are rotatably pivoted to constitute a vertically deformable rhombic link. An actuation lever having threads formed therealong is rotatably screw-coupled to the rhombic link along the horizontal orthogonal line, so that the load receiver may be displaced vertically by rotating the actuation lever thereby deforming the rhombic link.

The jack of the type described above is generally adapted such that the mating ends of the paired right and left arms are brought into rolling contact with each other under frictional resistance in the bearing portions so that the movements of the four arms are made equal to each other. For ensuring the rolling contact, the ends of the paired right and left arms attached to the bearing members are meshed with each other through a gear coupling in the prior art. However, since this structure requires steel material of a great thickness for forming gears, it can not meet the demand for reducing the weight of the jack. Further, although there has also been used a flange-reinforced thin plate material formed into the shape of gear teeth, the plate material undergoes severe fabrication upon forming the gear and, as a result, the material is degraded to reduce the strength, as well as high accuracy can not be obtained with ease in this case.

In view of the above, rolling contact means that utilize paired cams brought into contact with each other have been employed in recent years.

As such cam contact means, the present inventor has already developed an arm having a first cam of a heart-shaped curved face as an effective cam face which is formed at one of the side plate edges and a second cam of the same heart-shaped curved face as an effective can face which is formed in a different direction to the other of the side plate edges, respectively, of an arm shaft bearing member bended into a U-shaped cross section and has already filed an invention relating to such an arm as Japanese Patent Application No. 166343/1982. In the rolling contact means of this prior application, paired cam faces formed on both of the parallel side edges of one arm that is pivoted to one of shaft holes are brought into rolling contact with the identically shaped opposing paired cam faces of another arm that is pivoted to the other of the shaft holes. However, since each of the opposed cam faces is in a heart-shaped curved face with a small radius of curvature, no intimate engagement can be obtained between them thus failing to obtain satisfactory frictional resistance upon contact. Particularly, since the cam contact becomes insufficient in the angular range between the opposed arms, which is actually used most frequently, load balance between each of the arms is lost thereby causing dangers.

OBJECT OF THE INVENTION

The object of this invention is to provide an arm unit for use in a jack in which a main driving cam and a driven cam arm are disposed in parallel with each other to the rolling contact portion of each of opposed U-cross sectioned arms constituting a pantograph type jack, wherein the opposed top ends of each pair of right and left arms are well-engaged to each other under rolling contact over a wide range of rotational angle.

SUMMARY OF THE INVENTION

The foregoing object can be attained in accordance with this invention by an arm unit for use in a pantograph type jack having a rhombic link structure constituted by pivoting the upper and lower ends of respective right and left paired swingeable links to a pair of shaft holes that are formed while being spaced apart by a predetermined distance from each other to a pair of upper and lower shaft bearing members respectively in which each of the right and left paired swingeable links comprises upper and lower support arms pivoted respectively to each other at their opposed ends, wherein the end of each of the arms on the side formed with a mounting hole aligned with the shaft hole in the bearing member is shaped into a U-cross sectioned frame opened toward the inside of the rhombic link, a main driving cam that has an effective cam face constituted with an arc of a circle with the radius r and having the center at a point P situated above the axial line x in parallel with the bottom side of the arm passing through the center for the mounting hole is disposed to one side plate of the U-cross sectioned frame, with the effective cam face being protruded forwardly and upwardly from the mounting hole and, while on the other hand, a driven cam that has an effective cam face of a shape constituted with a curve that defines a region inside of a group of continuously moving traces of the arc-shaped cam face of the main driving cam plate from a region outside thereof when the pair of opposed arms and attached to a pair of the shaft holes and in the shaft bearing member are rotated at an equal angular velocity in the opposing direction.

DETAILED DESCRIPTION OF THE PREFERRED EMBODIMENT OF THE INVENTION

Figure 1:
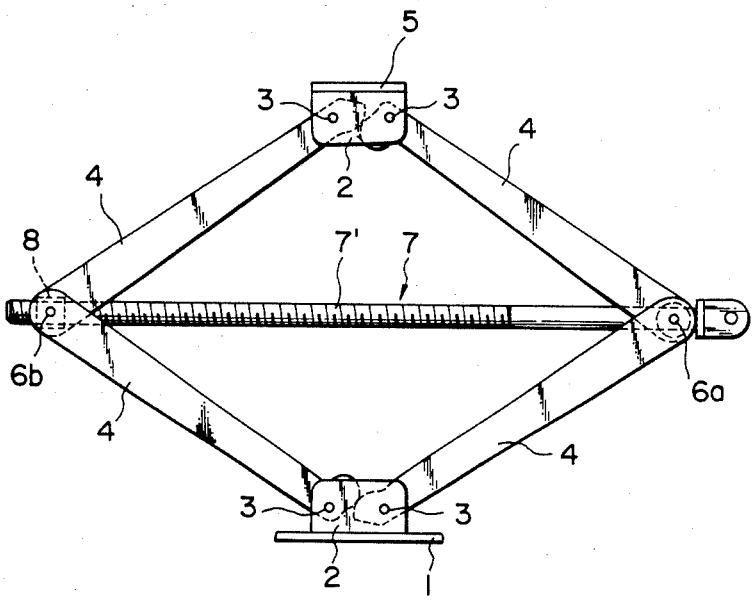
FIG. 1 is a schematic front elevational view for one embodiment of a rhombic link using an arm units according to this invention.

As shown in FIG. 1, a pantograph type jack according to this invention comprises a pair of lower right and left arms 4 and 4 which are rotatably pivoted respectively at their top ends to a pair of shaft holes 3 and 3 in a lower bearing member 2 integrated with a grounded base block 1 and a pair of upper right and left arms 4 and 4 each in the identical shape with that of the lower arms 3 and 3 and which are rotatably pivoted respectively at their top ends to a pair of shaft holes 3 and 3 in a upper bearing member 2 integrated with a load receiver 5. Corresponding base ends of the respective upper and lower right and left arms, 4, 4,--- are pivoted with each other so as to constitute a deformable rhombic link structure.

An actuation lever 7 having a male screw 7' formed axially from the midway toward the top end thereof is rotatably journaled at one end thereof to the right pivotal end **6*a* of the rhombic link while screw-coupled at the male screw portion 7' thereof into a female screw formed to the inside of a shaft bearing 8 attached to the left pivotal end 6*b*** of the link portion.

In this way, the rhombic link is supported by the actuation lever 7 disposed in the direction of the orthogonal line along the horizontal direction and expanded or folded vertically by the rotation of the actuation lever 7 thereby displacing the load receiver 5 vertically.

Figure 2:
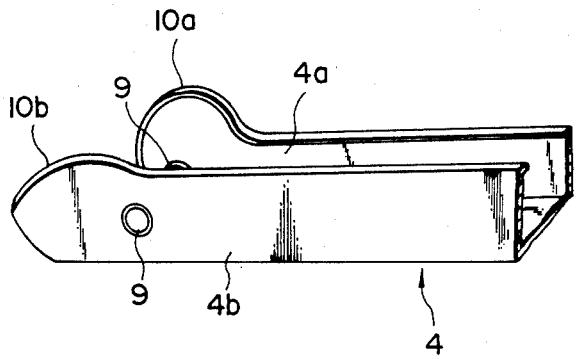
FIG. 2 is a perspective view of an unit arm used for the link shown in FIG. 1.
Figure 3:
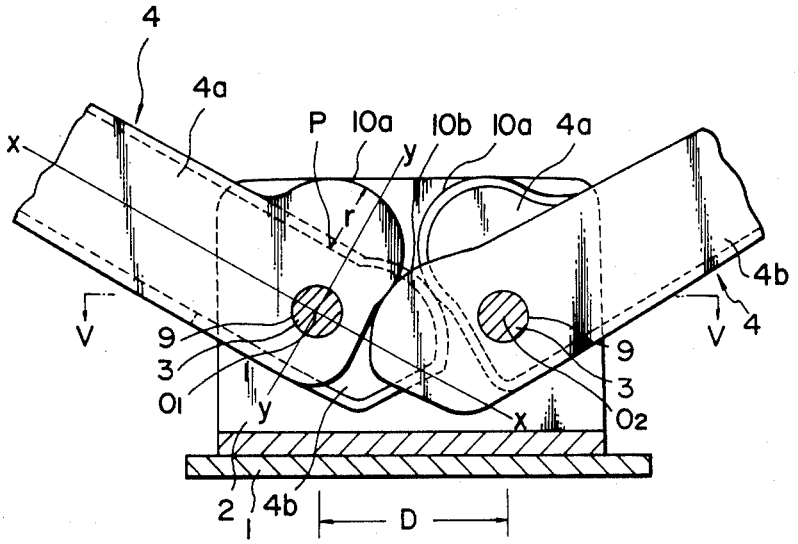
FIG. 3 is an explanatory view illustrating a pair of opposed arms brought into rolling contact with each other.

Each pair of the upper and lower arms 4 and 4 is pivoted by means of mounting holes 9 to a pair of shaft holes 3 and 3 which are formed to the shaft bearing member 2 while spaced apart from each other by a predetermined distance D as shown in FIGS. 2 and 3.

In the rhombic link of the embodiment according to this invention, the top ends of the opposing paired arms are brought into engagement under contact with each other by way of their cam faces. The term "engagement under contact" collective involves the cases where the top ends of the arms are caused to roll and slide while brought into contact with each other.

This invention concerns an arm unit for use in the pantograph type jack as described above and, more specifically, it relates to a cam structure of the portions engaged under contact. As specifically shown in FIG. 2, both side walls of the arm 4 are bent into a U-cross sectioned frame. A main driving cam **10*a* having an arc of a circle as an effective cam face is formed to the edge on one side plate 4*a*, while being protruded forwardly and upwardly therefrom. While on the other hand, a driven cam 10*b* having a relatively moderate curve and different from the shape of the cam 10*a* is formed to the edge on the other side plate 4*b* so as to be brought into engagement under contact with the main driving cam 10*a* of the mating arm pivoted to the other shaft hole 3 of the bearing member 2 (refer to FIG. 3**).

Figure 4:
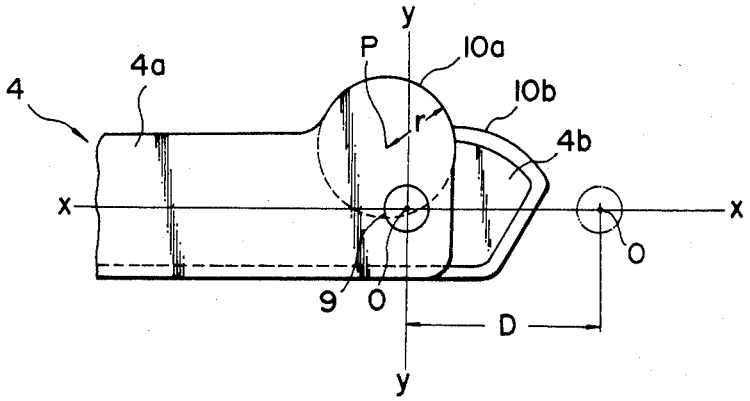
FIG. 4 is a detailed fragmentary front elevational view of the arm.
Figure 5:
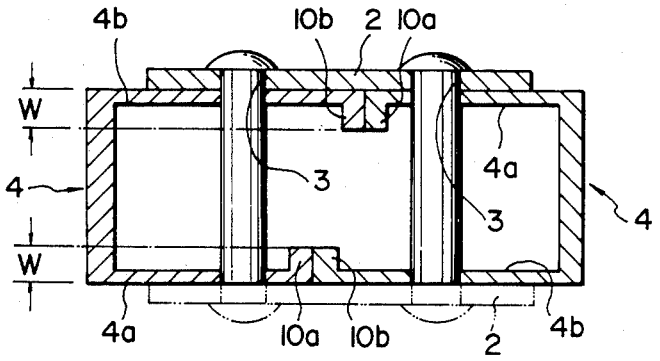
FIG. 5 is a transversal cross-sectional view of the opposed arms brought into rolling contact with each other.

Specifically, as shown particularly in FIGS. 3 and 4, the main driving cam **10*a* has, as an effective cam face, an arc forming a portion of a circle with a radius r having the center at a point P situated above the horizontal axial line x which is in parallel with the bottom side of the arm and passes through the center O for the mounting hole 9 of the arm 4** and the cam face is formed so as to extend forwardly and upwardly from the mounting hole O.

In a preferred embodiment, as shown in FIGS. 3 and 4, the radius r for the arc that constitutes the main driving cam **10*a* is set to about one-third of the distance D between the centers $O_1$ and $O_2$ for the pair of the shaft holes 3 and 3 of the bearing member 2, and the center P for the arc is situated near the vertical axial line y while being spaced upwardly from the center point O for the mounting hole 9** substantially by the same distance as the radius r.

While on the other hand, the driven cam **10*b* has a relatively moderate curved face as shown, for example, in FIG. 4, which is brought into rolling contact with the main driving cam 10*a* of the other opposed arm 4 pivoted to the bearing member 2. The outer circumferential profile of the driven cam 10*b* can be determined as a curve that defines a region inside of a group of continuously moving traces of the arc-shaped cam face of the main driving cam 10*a* from a region outside thereof when the pair of the opposed arms 4 and 4 pivoted to the pair of the shaft holes 3 and 3 in the bearing member 2 are rotated each at an equal angular velocity. The curved face of the driven cam 10*b*** is actually determined, for example, as described below.

Figure 6:
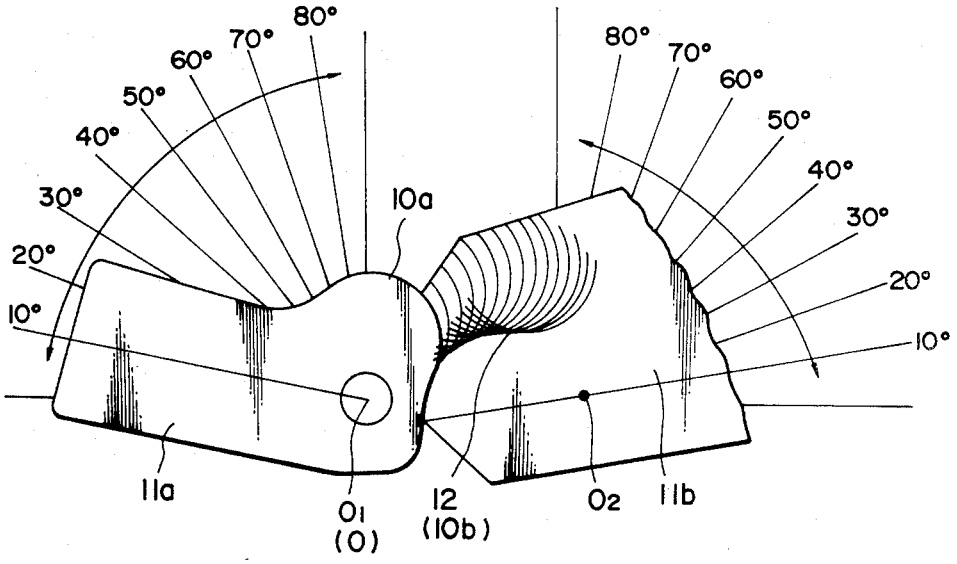
FIG. 6 is an explanatory view for illustrating the method of defining the cam face for the driven cam member.

As shown in FIG. 6, a sheet **11*b* used for determining the shape of the curved face on the outer circumference of the driven cam 10*b* is pivoted at the center $O_2$, whereas a sheet 11*a* having the outer profile of the driving cam 10*a* is pivoted at the center $O_1$. In this case, $O_1$ and $O_2$ are defined as the centers for the shaft holes 3 and 3 disposed in the bearing member 2 spaced apart from each other by the predetermined distance D as described above referring to FIG. 3. The sheet 11*a* and the sheet 11*b* are rotated at an angular velocity equal to each other in the opposing direction (that is closing to or aparting from each other). Then, the arcuate cam face of the main driving cam 10*a* continuously draws a group of traces of moving arcs on the sheet 11*b* as the sheet 11*a* rotates relative to the plane of the sheet 11*b*. Thus, the effective cam face of the driven cam 10*b* that can be brought into engagement under contact with the cam face of the main driving cam 10*a* can be obtained as a curve 12 traced on the sheet 11*b* that divides the plane of the sheet 11*b*** into a region defined inside of a group of continuously moving traces of arcs and a region defined outside thereof.

The curved cam shape of the driven cam **10*b* brought into intimate engagement with the main driving cam 10*a* can thus be determined, and the main driving cam 10*a* and the driven cam 10*b* are formed in parallel integrally on both side plates 4*a* and 4*b* of the U-cross sectioned arm 4 on the side of the mounting hole 9**.

As shown in FIG. 6, the edge of each side plates **4*a* and 4*b* is turned back at least in the portion formed with the effective cam face so that a substantial cam width can be obtained as the turned back width W. On the other hand, the portion of the side plates 4*a* and 4*b*** below the effective cam face is preferably cut away properly so that the portion may not hinder the rotation of the cams. The arm unit of the embodiment according to this invention can be prepared integrally from a steel sheet by punching and then applying bending fabrication.

The operation and the effect of this invention will now be described below.

The arm unit according to this invention is used in a state being assembled as shown in FIG. 1. Each pair of the opposed arms 4 and 4 pivoted respectively to a pair of shaft holes 3 and 3 in each of the upper and lower shaft bearing members 2 and 2 is rotated in such a direction that the opposed arms 4 and 4 are rotated in the directions opposite to each other while bringing the main driving cam 10*a* and the driven cam 10*b* into intimate engagement under contact to each other.

In this way, since each of the upper and lower paired arms 4, 4,----- can be rotated with the main driving cam 10*a* and the driven cam 10*b* being in intimate contact with each other in each of the pivotal portions of the shaft bearing members 2 and 2, the four arms can surely be rotated each at an identical angular velocity and the load can be received in a well-balanced manner.

The cam face of the main driving cam 10*a* is formed as an arc of a circle, while the shape of the driven cam 10*b* constitutes a moderate curved face extended forward of the arc in this invention. Accordingly, the main driving cam 10*a* and the driven cam 10*b* can be engaged more intimately to obtain more stable engagement under contact. Particularly, since the driven cam 10*b* has a moderate cam face extended forward of the main driving cam 10*a* in the arm unit of this invention as shown in FIG. 3, the length for the engaging contact is not identical between the driving cam 10*a* and the driven cam 10*b*, but the length of the driven cam 10*b* is longer. Accordingly, when the two arms 4 and 4 are rotated at an identical angular velocity, the driven cam 10*b*, while sliding at a greater speed, intrudes toward the main driving cam 10*a*, thereby establishing a more effective engagement. Particularly, the embodiment shown in FIGS. 3 and 4 is designed such that the driven cam slides most efficiently within range of the opening angle between the opposed arms from 160° to 60° in the jack, which is most frequently used in the actual operation.

Although this invention has been described referring to preferred embodiment illustrated in the drawings, various modifications and alterations are possible without departing the gist and the scope of the invention.

What is claimed is:

1. An arm unit for use in a pantograph type jack having a rhombic link structure constituted by pivoting the upper and lower ends of respective right and left paired swingeable links to a pair of shaft holes that are formed while being spaced apart by a predetermined distance from each other to a pair of upper and lower shaft bearing members respectively, in which each of said right and left paired swingable links comprises upper and lower support arms pivoted respectively to each other at their opposed ends, wherein the end of each arm is formed with a mounting hole aligned with the shaft hole of the bearing member and is shaped into a U-cross sectioned frame opening toward the inside of said rhombic link thereby providing side plates, a main driving cam that has an effective cam face constituted by an arc of a circle with a radius r and having a center thereof at a point P situated above an axial line x in parallel with the bottom side of said arm passing through the center of the mounting hole is formed on top of one of the side plates of the U-cross sectioned frame, with the effective cam face being protruded forwardly and upwardly from the mounting hole and a driven cam is formed on the other side plate which driven cam has an effective cam face of a shape constituted by a curve that defines a region inside of a plurality of continuously moving traces of the arc-shaped cam face of said main driving cam plate from a region outside thereof when the pair of opposed arms attached to a pair of the shaft holes in said shaft bearing member are rotated at an equal angular velocity in the opposing directions.

2. The arm unit as defined in claim 1, wherein the radius r for the arc of the circle constituting the main driving cam is about one-third of the distance between the centers of the pair of the shaft holes in the shaft bearing member and the center P of the circle is situated near a vertical line Y passing through the center of the mounting hole of the arm and spaced apart upwardly by about the same distance as the radius r.

3. An arm unit as defined in claim 1 or 2, wherein the length of the effective contact face of the driven cam is substantially longer than that of the main driving cam.

* * * * *